United States Patent [19]

Fukuoka et al.

[11] Patent Number: 4,590,988

[45] Date of Patent: May 27, 1986

[54] METHOD AND APPARATUS FOR SUPPLYING MOLTEN METAL IN THE MANUFACTURE OF AMORPHOUS METAL RIBBONS

[75] Inventors: Hiromi Fukuoka; Keisuke Asano; Hideo Ide, all of Kitakyushu, Japan

[73] Assignee: Nippon Steel Corporation, Tokyo, Japan

[21] Appl. No.: 651,766

[22] Filed: Sep. 18, 1984

[30] Foreign Application Priority Data

Sep. 26, 1983 [JP] Japan ..... 58-176351

[51] Int. Cl.[4] ..... B22D 11/10; B22D 11/06

[52] U.S. Cl. ..... 164/463; 164/479; 164/488; 164/423; 164/429; 164/437; 164/335; 222/595; 222/603

[58] Field of Search ..... 164/335, 437, 133, 462, 164/463, 423, 479, 488, 429; 222/108, 109, 595, 603

[56] References Cited

U.S. PATENT DOCUMENTS

| | | | |
|---|---|---|---|
| 2,399,634 | 5/1946 | Holland et al. | 222/595 |
| 3,581,948 | 8/1969 | Detalle | 222/603 |
| 3,608,621 | 4/1970 | Bollig | 164/437 |
| 3,838,798 | 10/1974 | Voss | 222/603 |
| 4,003,561 | 1/1977 | Cudby | 222/603 |
| 4,449,568 | 5/1984 | Narasimham | 222/595 |

FOREIGN PATENT DOCUMENTS

| | | | |
|---|---|---|---|
| 57-57533 | 12/1982 | Japan | 164/61 |

*Primary Examiner*—Nicholas P. Godici
*Assistant Examiner*—Samuel M. Heinrich
*Attorney, Agent, or Firm*—Wenderoth, Lind & Ponack

[57] ABSTRACT

In a method of manufacturing amorphous metal ribbons by ejecting molten metal through a nozzle attached to a tundish onto a rapidly moving cooling body, the molten metal is suppled to the tundish by first pouring the molten metal from a ladle into an intermediate vessel and then by supplying the molten metal from the intermediate vessel to the tundish through a gas-lift pump. An apparatus for supplying molten metal to a tundish comprises an intermediate vessel adjacent to the tundish and a gas-lift pump to supply the molten metal from the intermediate vessel to the tundish. The molten metal is poured from a ladle into the intermediate vessel. The gas-lift pump has a pump proper that is placed over the intermediate vessel and tundish so that its inlet and outlet open in the intermediate vessel and tundish, respectively. Bubbles are suppled into the pump proper through its inlet.

14 Claims, 8 Drawing Figures

METHOD AND APPARATUS FOR SUPPLYING MOLTEN METAL IN THE MANUFACTURE OF AMORPHOUS METAL RIBBONS

BACKGROUND OF THE INVENTION

1. Field of the Invention

This invention relates to a method and apparatus for supplying molten metal in the manufacture of amorphous metal ribbons and, more particularly, to a method and apparatus for supplying molten metal to a tundish.

2. Description of the Prior Art

In recent years, amorphous metals have been attracting increasing attention because of their excellent magnetic properties. Amorphous metals are made into product form by continuously ejecting the molten metal stored, for instance, in a tundish through a fine slit at the nozzle tip onto the surface of a cooling roll rotating at high speed to rapidly cool and solidify the metal. The amorphous metal ribbons thus obtained are as thin as about 25 μm. Accordingly, the rate of the metal supply onto the cooling roll surface is far lower than the rate at which molten metal is supplied from the tundish to the mold in ordinary continuous casting. It is therefore necessary to stabilize the amount of metal ejected through the fine slit of the nozzle by adjusting the head or level of the molten metal in the tundish. As such, it has been strongly desired to establish a method that permits implementing fine adjustment of the molten metal supply rate from a ladle or other container to the tundish.

FIG. 1 shows an example of a conventional method of supplying molten metal in the manufacture of amorphous metal ribbons. According to this method, molten metal M is supplied from a ladle 1 through a sliding nozzle 2 and a long nozzle 3 to a tundish 4. While maintaining the metal bath at a constant level, the molten metal M is ejected through a slit 7 of a nozzle 6 onto the surface of a rapidly rotating cooling roll 8 by adjusting a stopper 5.

The amount of molten metal M supplied from the ladle 1 to the tundish 4 is controlled by adjusting the opening of the sliding nozzle 2. In order to permit the makeup of the molten metal ejected through the nozzle slit 7, the opening of the sliding nozzle 2 must be quite small. However, the probability is quite strong that such a small opening might get clogged and thereby make it impossible to continue the supply of molten metal to the tundish in a short time.

Let it be assumed that the bath level $H_1$ in the ladle 1 at the start of pouring is 20 cm, the distance $H_2$ between the bath level in the tundish 4 and the bottom of the ladle 1 is 60 cm, the length and width of the nozzle slit 7 are 15 cm and 0.06 cm, and the discharge rate of molten metal from the nozzle slit 7 is 150 cm/sec. In order to replace the molten metal M discharged through the nozzle slit 7 from the ladle 1, the diameter of the hole provided in the plate of the sliding nozzle 2 must be about 7 mm. This is far smaller than the hole diameter of an ordinary sliding nozzle that stands at around 70 mm. Such a small hole might get clogged in a short time and therefore does not permit the continuous supply of a small quantity of molten metal from the ladle 1 to the tundish 4.

There is also another method that supplies molten metal from a ladle placed in a hermetically sealed container to a tundish that is connected to the ladle by a refractory U-tube by applying pressure on the surface of the molten metal in the ladle. Still another method employs a ladle and a tundish that are connected by a refractory U-tube equipped with a vacuum unit that draws the molten metal from the ladle for transfer into the tundish.

But these methods require costly equipment including a hermetically sealed container large enough to accommodate a ladle, a vacuum unit and a hermetically sealed refractory U-tube. Another drawback is the difficulty encountered in taking a prompt remedial measure against the metal leakage and other accidents.

Yet another method employing an electromagnetic pump is impractical because it involves too heavy a capital investment.

SUMMARY OF THE INVENTION

An object of this invention is to provide a method and apparatus for supplying molten metal in the manufacture of amorphous metal ribbons that are inexpensive and free from the aforementioned shortcomings of the conventional methods, and which permit continuous supply of a small amount of molten metal at a finely regulated rate.

Another object of this invention is to provide a method and apparatus for supplying molten metal in the manufacture of amorphous metal ribbons that assure a continuous supply of molten metal over a long period of time without being interrupted by nozzle clogging or metal leakage.

In manufacturing amorphous metal ribbons by ejecting molten metal from a nozzle attached to a tundish onto the surface of a rapidly moving cooling means, a method of supplying molten metal to the tundish according to this invention comprises the steps of pouring the molten metal from a ladle to an intermediate vessel, and thence to the tundish by way of a gas-lift pump.

An apparatus for supplying molten metal to a tundish according to this invention comprises an intermediate vessel adjoining the tundish and a gaslift pump that sends the molten metal from the intermediate vessel to the tundish. The molten metal is poured from a ladle into the intermediate vessel. The gas-lift pump comprises a pump proper that is placed over the intermediate vessel and tundish, with the inlet and outlet thereof opening into the intermediate vessel and tundish, respectively. Bubbles are supplied into the pump proper through the inlet thereof.

On account of the structure just described, the apparatus of this invention eliminates the need for providing a nozzle stopper or sliding plate between the ladle and tundish. Since the pump contains a mixture of air and liquid, a pipe of a larger diameter can be used than can be used in a system containing only liquid. This permits simplifying the structure of the molten metal supplying apparatus and reduces the likelihood of passage clogging.

The amount of metal supply can be controlled by adjusting the quantity of the bubbles supplied to the gas-lift pump. All this facilitates the supply of a slight quantity of molten metal at a finely controlled rate that is strongly desired in the manufacture of amorphous metal ribbons.

DESCRIPTION OF THE PREFERRED EMBODIMENTS

Embodiment 1

Figure 2:
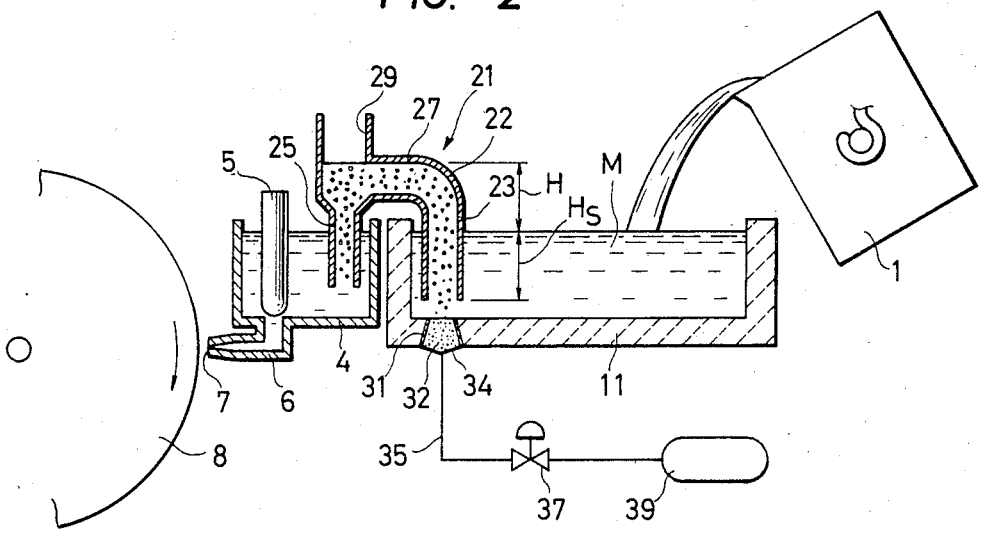
FIGS. 2 and 3 are a vertical cross-sectional view and a perspective view showing an example of a molten metal supplying apparatus according to this invention that employs a gas-lift pump.
Figure 3:
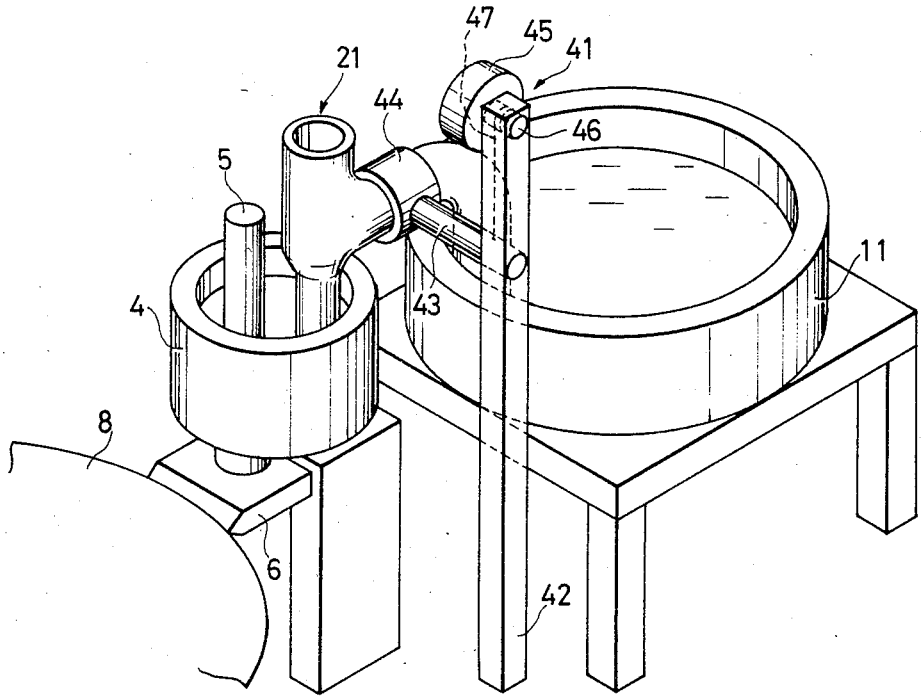

FIGS. 2 and 3 show an example of an apparatus used in implementing a method of supplying molten metal according to this invention.

Figure 1:
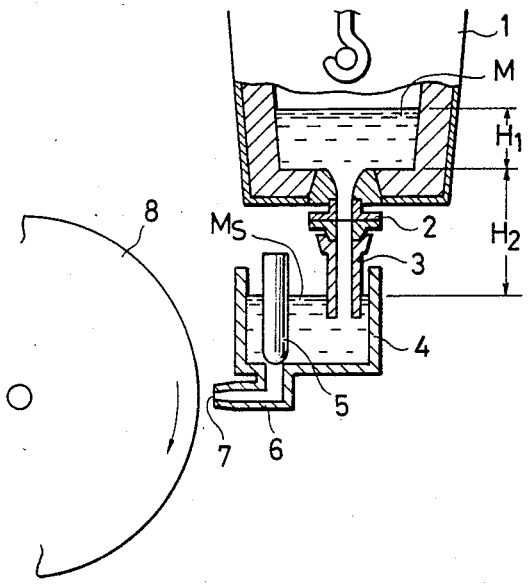
FIG. 1 PRIOR ART
FIG. 1 is a vertical cross-sectional view of a conventional apparatus that supplies molten metal from a ladle to a tundish through an opening provided by a sliding nozzle in the manufacture of amorphous metal ribbons.

In these figures, the ladle 1, tundish 4, stopper 5, nozzle 6 and cooling roll 8 are similar to those shown in FIG. 1. In the description of this embodiment, therefore, they are designated by like reference characters, with the description thereof omitted.

A box-shaped intermediate vessel 11 made of refractory material is placed next to the tundish. Molten metal M is supplied from the ladle 1 into the intermediate vessel 11.

The pump member 22 of a gas-lift pump 21 is placed over the tundish 4 and intermediate vessel 11. The pump member 22 is U-shaped and made of refractory material, comprising an ascension pipe 23 extending vertically into the intermediate vessel 11, a discharge pipe 25 extending vertically into the tundish 4 and a connecting pipe 27 linking the top of the ascension pipe 23 with the top of the discharge pipe 25. The connecting pipe 27 has a vent 29 opening upward.

Where no adequate preheating is given, the pump member 22 must be made of material with high thermal shock resistance. That is, when no such preheating is given, the temperature of the pipe wall rises sharply in the early stage of operation to generate a large amount of thermal stress. If the thermal stress exceeds the strength of the pump member 22, cracks occur to cause metal leakage. To relieve the thermal stress, the material should have a low thermal expansion coefficient, low elasticity modulus or high heat conductivity. Fused quartz and aluminum titanate are typical substances with a low thermal expansion coefficient, while $Al_2O_3$—C composites are typical substances with a low elasticity modulus and high heat conductivity. If the pump member 22 is made of these materials, occurrence of thermal-stress-induced cracks can be reduced.

The bubble injection port 31 of the gas-lift pump 21 is provided in the bottom of the intermediate vessel 11 directly below the ascension pipe 23 of the pump member 22 extending vertically into the intermediate vessel 11. A gas-bubbling porous plug 32 is fitted in the bubble injection port 31 which is connected to a gas supply pipe 35 through a metal fitting 34. To the gas supply pipe 35 is connected a compressed gas holder 39 through a flow control valve 37.

The pump member 22 is supported by an elevating device 41 as shown in FIG. 3. A strut 42 is erected next to the intermediate vessel 11, with an arm 43 slidably fitted in the strut 42. One end of the arm 43 carries the pump member 22 through a metal holder 44 and the other end of the arm 43 is fastened to an end of a wire 46 passed over the drum 47 of a winch 45. When the amorphous metal ribbon manufacturing apparatus is not operating, the elevating device 41 lifts the pump member 22 out of the intermediate vessel 11 and tundish 4.

In the apparatus described above, argon gas is supplied from the compressed gas holder 39 to the bubble injection port 31 through the gas supply pipe 35. At the exit end of the bubble injection port 31, the argon gas mixes with the molten metal M to form a mixture of gas and liquid. Because the specific weight of such a mixture is lighter than that of the molten metal alone, the gas-liquid mixture is pushed up through the ascension pipe 23 by the molten metal M on the outside thereof to a height above the liquid level in the intermediate vessel 11.

This relationship can be expressed as follows:

$$\gamma_m(H_s+H+\Delta h)=\gamma H_s \quad (1)$$

where:

$\gamma_m$ = mean specific weight of the gas-liquid mixture in the ascension pipe ($kg/cm^2 \cdot sec^2$), $H_s$ = immersion depth of the ascension pipe 23 in the intermediate vessel 11 (m), H = head (m), $\Delta h$ = flow resistance in the pump proper 22 induced by friction and exit losses and other factors (m), and $\gamma$ = specific weight of the molten metal ($kg/m^2sec^2$).

Having risen above the liquid level in the intermediate vessel 11, the gas-liquid mixture then separates into gas and molten metal because of the difference in the specific gravity thereof. While the gas is discharged outside the system through the vent 29, the molten metal flows into the tundish 4. This results in a reduction in the quantity of the molten metal M in the intermediate vessel 11. But the quantity thus lost is made up with the supply from the ladle 1, whereby the level of the molten metal M in the intermediate vessel 11 is kept within a given range.

On reaching a given level, the molten metal in the tundish 4 is supplied to the nozzle 6 by manipulating the stopper 5. Then, the molten metal is ejected through the nozzle 6 onto the surface of the cooling roll 8 that rotates at high speed and then cooled rapidly to form a ribbon of amorphous metal.

In the manufacture of amorphous metal ribbons, the quantity of molten metal M supplied per unit time is too small to be continuously made up with an uninterrupted supply from the ladle 1. Rather, it is easier to make up the loss at intervals every time the molten metal M in the intermediate vessel has dropped to a given level by adding the molten metal from the ladle 1 up to the original level. The quantity of gas supply is controlled by adjusting the flow control valve 37 so that the supply of the molten metal to the tundish 4 is held as constant as possible despite the level variation in the intermediate vessel 11.

Embodiment 2

Figure 4:
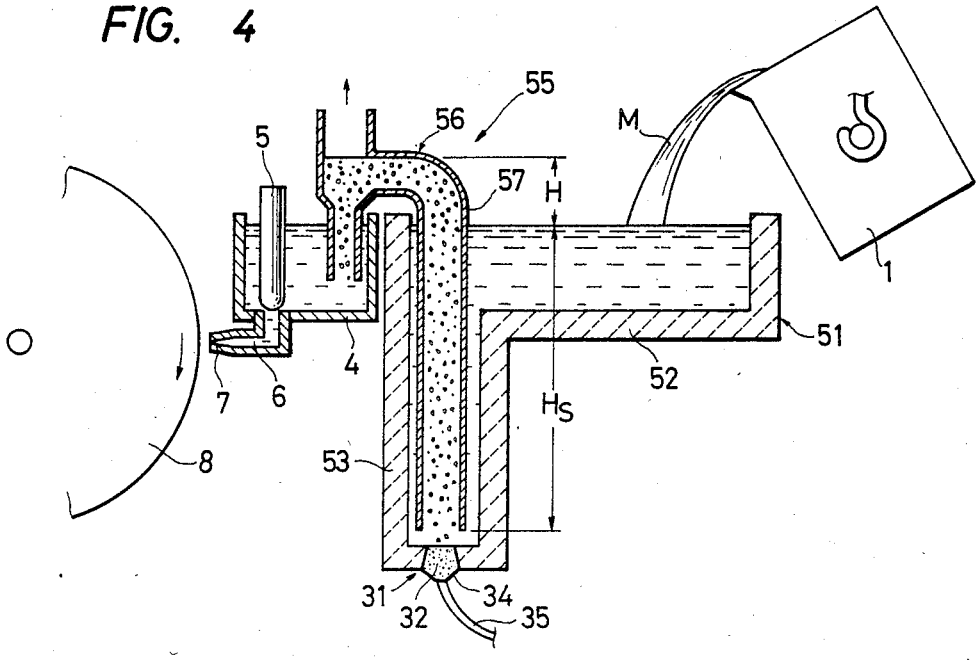
FIG. 4 is a vertical cross-sectional view showing another example of the molten metal supplying apparatus according to this invention.

Referring to FIG. 4, another embodiment of this invention will be described.

As shown, an intermediate vessel 51 comprises a molten-metal receiving section 52 into which molten metal M is poured from a ladle 1 and a molten-metal feeding section 53 that is deeper and smaller in cross-sectional area than the receiving section 52.

The inlet of an ascension pipe 57, which is a part of the pump member 56 of a gas-lift pump 55, entends close to the bottom of the molten-metal feeding section 53.

Other parts of this embodiment (the tundish, pump proper elevating device, and so on) and their functions are substantially identical with those of the first embodiment described before.

Preferably, the relationship between the head H(m) and the immersion depth $H_s$(m) of the ascension pipe 57 (which becomes greatest when the intermediate vessel is filled up with the molten metal and smallest when the molten-metal level drops to the bottom of the receiving section 52) should be kept within the limits $H_s/H=1.5$ to 2.3 even when the value of $H_s$ is minimum in view of the efficiency of the gas-lift pump.

In this embodiment, the quantity of residual molten metal can be reduced by making the volume of the molten-metal receiving section 52 of the intermediate vessel 51 larger than that of the molten-metal feeding section 53. When the supply of the molten metal M from the ladle 1 to the single-stage intermediate vessel 11 as shown in FIG. 2 is terminated, the level of the molten metal therein continues to drop as long as the supply to the tundish 4 is continued. When the ratio $H_s/H$ becomes smaller than a given value, little or no molten metal flows from the intermediate vessel 11 to the tundish 4 however much the gas flow rate is increased, thereby leaving a considerable quantity of residual molten metal in the intermediate vessel. Thus, the two-stage intermediate vessel of this embodiment provides higher yield than the single-stage one.

Embodiment 3

Figure 5:
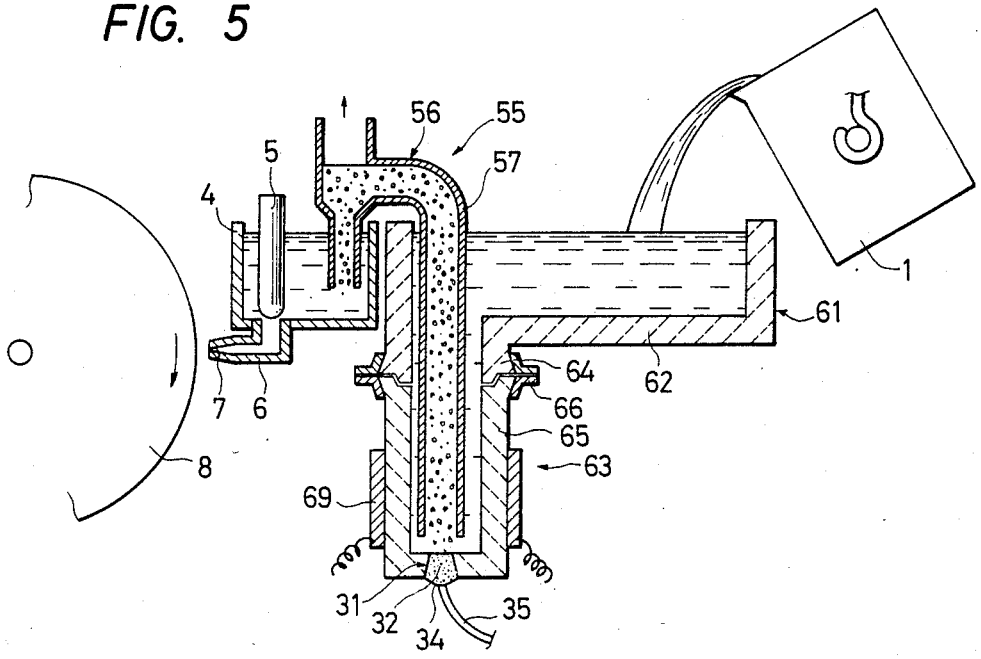
FIG. 5 is a vertical cross-sectional view of still another example of the molten metal supplying apparatus according to this invention, in which part of an intermediate vessel can be divided into top and bottom sections.

FIG. 5 shows still another preferred embodiment of this invention.

In this embodiment, a molten-metal feeding section 63 of an intermediate vessel 61 is divided into an upper portion 64 and a lower portion 65 at a point close to the bottom of a molten-metal receiving section 62. The two portions 64 and 65 are joined together by a flange-like rim 66 that is provided to prevent the leakage of the molten metal M from the molten-metal feeding section 63. A heating device 69, such as an electric heater, is attached to the lower portion 65 of the molten-metal feeding section 63 to heat the molten metal M, thereby enhancing the fluidity thereof and thus preventing the solidification and sticking thereof in the molten-metal feeding section 63.

When the apparatus is stopped on completion of the amorphous metal ribbon manufacturing process, the lower portion 65 of the molten-metal feeding section 63 is detached from the upper portion 64 thereof. Then, the residual molten metal M in the lower portion 65 is removed to a mold or other appropriate container. The metal thus recovered is melted again and supplied from the ladle 1 to the tundish 4 through the intermediate vessel 61. The detachable molten-metal feeding section 63 permits easy handling of the residual molten metal.

Embodiment 4

Figure 6:
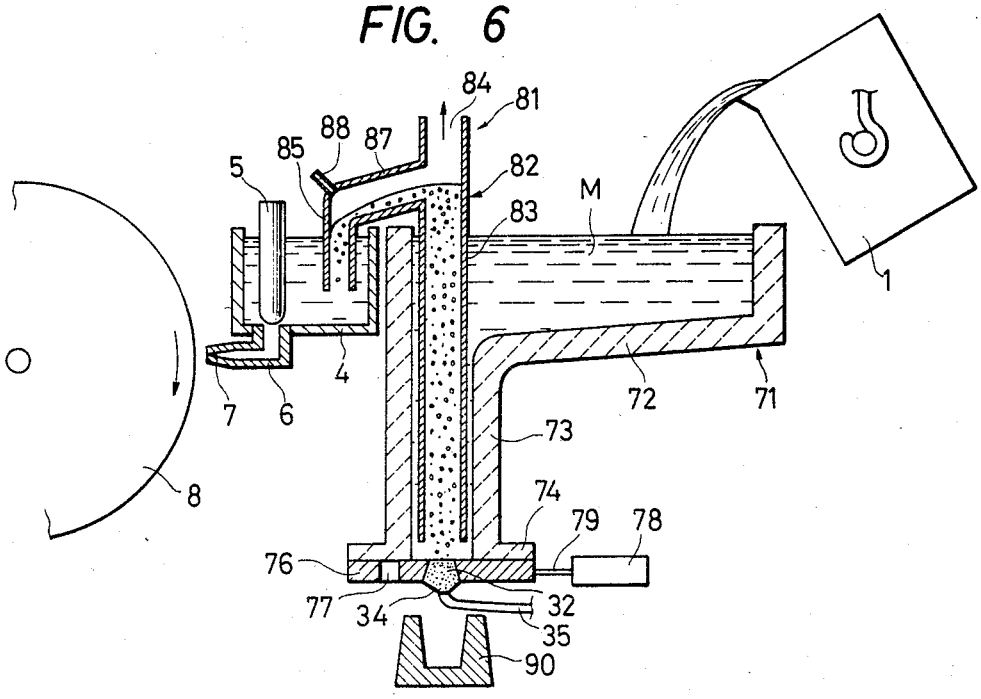
FIG. 6 is a vertical cross-sectional view of yet another example of the molten metal supplying apparatus according to this invention, in which the intermediate vessel is provided with a sliding plate that admits the bubbles directly to the intermediate vessel.

FIG. 6 shows yet another preferred embodiment of this invention.

The bottom of a molten-metal receiving section 72 of an intermediate vessel 71 is sloped toward a molten-metal feeding section 73, with the lower end of the molten-metal feeding section 73 opening downward and having a flange 74 thereon.

A sliding plate 76 is slidably kept in contact with the bottom surface of the flange 74 of the molten-metal feeding section 73. The sliding plate 76 has a gas-bubbling porous plug 32 at the center and a through-hole 77 near one end thereof. One end of the sliding plate 76 is connected to the rod 79 fitted in a hydraulic cylinder 78.

During operation, the sliding plate 76 is held in a position to keep the porous plug 32 directly below the ascension pipe 83 of the gas-lift pump 81. When the apparatus is stopped on completion of the amorphous metal ribbon manufacturing process, the sliding plate 76 is horizontally shifted by means of the hydraulic cylinder 78 to bring the through hole 77 directly below the ascension pipe 83. The residual molten metal M in the intermediate vessel 71 flows from the molten-metal receiving section 72 having an inclined bottom to the molten-metal feeding section 73, and then into a mold 90 through the hole 77.

In the pump member 82 of a gas-lift pump 81, a connecting pipe 87 is sloped toward the tundish 4. A vent 84 and a gas injection port 88 are provided directly above the ascension pipe 83 and the discharge pipe 85, respectively.

Inside the connecting pipe 87, the molten metal M flows in such a manner as to leave a space between itself and the pipe wall. Argon or other inert gas is sent into the space through the gas injection port 88 to prevent the molten metal from getting oxidized.

In blowing the inert gas into the ascension pipe through the porous plug, fine bubbles should preferably be distributed as uniformly as possible across the cross-section thereof from the viewpoint of efficiency. The uniform distribution of fine bubbles reduces the variation in the flow rate of molten metal, too.

Generally, the lower the gas flow rate per unit area of the gas emitting surface of the porous plug, the finer will be the bubbles obtained. This is because gas flows through holes that are easier to pass than others when the gas flow rate is low. Since such holes are spaced apart from each other, the resulting bubbles remain uncombined. For the same gas flow rate, therefore, finer bubbles are obtained when the area of the gas emitting surface is larger.

Figure 7:
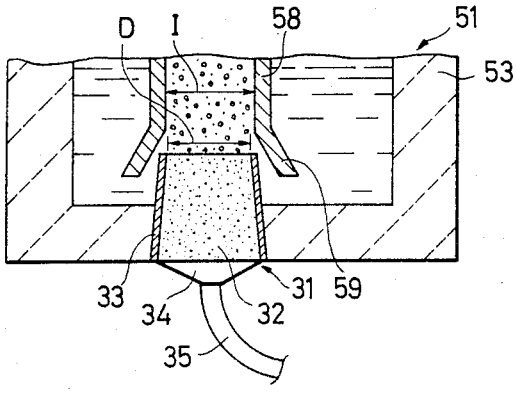
FIG. 7 schematically illustrates the structure of an ascension pipe and a porous plug that assures a uniform distribution of the bubbles across the gas-lift pump.

For this reason, it is preferable to make the diameter D of the gas emitting surface substantially equal to the inside diameter I of the ascension pipe 58 and also to provide a flared skirt 59 at the lower end of the ascension pipe 58 so that the entire gas emitting surface is contained therein as shown in FIG. 7. It is necessary to provide a clearance for the molten metal M to pass through by ensuring that the porous plug 32 does not fill up the ascension pipe 58.

Generally, porous refractories contain many minute open spaces which will provide the desired gas permeability, with a resulting decrease in strength and corrosion resistance. In forming the porous plug 32, therefore, it is preferable to enclose the porous refractory with a stronger refractory material 33 less susceptible to the attack of the molten metal.

The gas intake is not limited to the porous plug at the bottom. A bubble injection port may be provided near the inlet of the ascension pipe.

Figure 8:
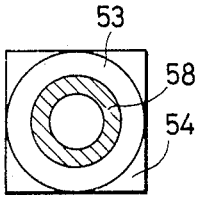
FIG. 8 schematically illustrates a horizontal section of molten-metal feeding sections of the intermediate vessel having a circular and a rectangular cross-sections.

As mentioned previously, the larger the volume of the molten-metal receiving section as compared with the volume of the molten-metal feeding section, the more desirable for the intermediate vessel. The specific design of the intermediate vessel is determined by the quantity of molten metal, tie-in with other equipment, and several other factors. If the shortest horizontal and vertical distances between the ascension pipe and the internal surface of the molten-metal feeding section are the same, the molten-metal feeding section of a circular horizontal cross-section permits reducing the quantity of residual metal to a greater extent than that of a rectangular cross-section. This is obvious from FIG. 8 that shows the horizontal cross-section of the molten-metal feeding section in which the ascension pipe is inserted. Let it be assumed that the outside diameter of the ascension pipe 58 is 12 cm and the inside diameter of the circular molten-metal feeding section is 16 cm and also that the internal wall 54 of the rectangular molten-metal feeding section circumscribes the circular one. Then, the horizontal cross-sectional areas left between the external surface of the ascension pipe 58 and the internal walls 53 and 54 of the circular and rectangular molten-metal feeding sections 53 and 54 are 88.0 and 142.9 $cm^2$, respectively, the former being only about 60 percent of the latter.

Nonmetallic inclusions contained in the molten metal are adsorbed by the bubbles in the ascension pipe of the pump proper and float up to the surface with the bubbles where the bubbles and molten metal separate from each other. On account of this bubble separation, the quantity of the nonmetallic inclusions carried into the tundish with the molten metal is reduced, which, in turn, decreases the occurrence of product defects induced by the nonmetallic inclusions. The quantity of the nonmetallic inclusions entrapped in the product can be further reduced by coating on the internal wall of the gas-lift pump a refractory material that adsorbs greater amounts of inclusions such as the CaO-based refractories for the $Al_2O_3$-based inclusions and the CaO- or MgO-based refractories for the $SiO_2$-based inclusions.

EXAMPLE OF MANUFACTURING AMORPHOUS METAL RIBBONS

The method of this invention was implemented in supplying molten metal M from the intermediate vessel 51 to the tundish 4 in the amorphous metal ribbon manufacturing apparatus of FIG. 4. The specific weight and temperature of the molten metal used was 7.2 and 1400° C., whereas the length and width of the slit 7 of the nozzle 6 were 15 cm and 0.06 cm, with the molten metal ejected through the nozzle slit 7 at a rate of 150 cm/sec. The lost molten metal M was replaced at a rate of 135 $cm^3$/sec. In order to provide this rate, the inside diameter of the ascension pipe 57 of the gas-lift pump 55 was set at 81 mm, with the values of $H_s$ and H standing at 310 and 150 mm when the level of the molten metal in the molten-metal feeding section 53 was flush with the bottom of the molten-metal receiving section. When the tundish had been filled with the molten metal, casting was started, with argon gas injected through the bubble injection port 31. With a maximum gas flow rate of approximately 20 normal liter/minute (Nl/min.) , the desired quantity of the molten metal M was smoothly and continuously supplied to the tundish 4.

It should be noted that this invention is by no means limited to the preferred embodiments described above. For instance, the molten metal may be cooled by use of an endless belt in place of the cooling roll. The bottom of the molten metal receiving sections 52 and 62 of the intermediate vessels 51 and 61 shown in FIGS. 4 and 5 may be sloped as shown in FIG. 6. A heater may be provided around the molten-metal receiving sections shown in FIGS. 4 and 6. Also, the pump members shown in FIGS. 4 and 5 may be replaced with the one shown in FIG. 6.

What is claimed is:

1. In a method of manufacturing amorphous metal ribbons by ejecting molten metal from a nozzle attached to a tundish onto the surface of a rapidly moving cooling body, an improved method of supplying the molten metal to the tundish, which comprises:

pouring the molten metal from a ladle into an intermediate vessel separate from and positioned beside the tundish; and supplying the molten metal from the intermediate vessel to the tundish by placing the lower end of an ascension pipe of a gas-lift pump into the molten metal in the intermediate vessel and placing the lower end of the discharge pipe of the gas-lift pump in the molten metal in the tundish, supplying bubbles of an inert gas to the lower end of the ascension pipe for lifting molten metal from the intermediate vessel, transferring said molten metal and then down into the tundish, and venting the gas from the top of the gas-lift pump.

2. In an amorphous metal ribbon manufacturing apparatus having a rapidly moving cooling body and a tundish having a nozzle to eject molten metal onto the surface of the cooling body, and a molten metal supply means for supplying molten metal, an apparatus for supplying the molten metal from said supply means to the tundish which comprises:

an intermediate vessel separate from the tundish and disposed beside the tundish and positioned for receiving the molten metal from the supply means; and a gas-lift pump for supplying the molten metal from said intermediate vessel to the tundish, said gas-lift pump having a pump member placed over said intermediate vessel and the tundish and being constituted by an ascension pipe and a discharge pipe, said pipes being spaced laterally from each other and being connected at the upper ends, said ascension pipe having the lower end opening into said intermediate vessel adjacent the bottom thereof and said discharge pipe having the lower end opening into the tundish at a level below the normal level of molten metal in the tundish, vent means at the top of said pump member for discharging gas therefrom, and means adjacent the bottom of said ascension pipe for supplying bubbles of inert gas into the bottom of said ascension pipe.

3. An apparatus according to claim 2 further comprising means for moving the pump member of said gas-lift pump, the moving means being adapted to adjust the vertical position of the pump member relative to the intermediate vessel.

4. An apparatus according to claim 2 in which said bubble supplying means includes a gas supplying port having a porous insert therein, and the diameter of the gas discharging surface of said insert is substantially equal to the inside diameter of said ascension pipe, and the lower end of said ascension pipe is spaced above said insert and has a downwardly and outwardly flared skirt thereon.

5. An apparatus according to claim 2, in which the internal surface of the pump member of said gas-lift pump is lined with refractories of the kind that adsorbs inclusions in the molten metal.

6. An apparatus according to claim 2, in which the bubble supplying means is provided in the bottom of the intermediate vessel directly below the ascension pipe of the pump and extends vertically therein.

7. An apparatus according to claim 6 in which said bubble supplying means has a bubble injecting port and a porous plug fitted in said bubble injecting port, said plug having a strong refractory layer therearound which is of a refractory material that is less susceptible to attack by the molten metal than the material of said plug.

8. An apparatus according to claim 2, in which said intermediate vessel comprises:

a molten-metal receiving section into which molten metal is poured from said supply means; and a molten-metal feeding section that is deeper and smaller in cross-section than the molten-metal receiving section and into which the lower end of said ascension pipe extends.

9. An apparatus according to claim 8 further comprising means for heating the molten metal in the molten-metal feeding section mounted thereon.

10. An apparatus according to claim 9 in which said bubble supplying means comprises a bubble injecting port, gas piping supplying gas to said port, and a flow control valve in said piping.

11. An apparatus according to claim 8, in which said molten-metal feeding section is made of separable upper and lower portions, whereby the lower portion can be removed for removing residual molten metal therefrom.

12. An apparatus according to claim 8, in which the bottom of said molten-metal receiving section is sloped toward the molten-metal feeding section.

13. An apparatus according to claim 8 in which said molten-metal feeding section has an aperture opening downward, a sliding plate adapted to close the aperture, and a cylinder unit to move the sliding plate, the sliding plate having a bubble injecting porous plug and a hole spaced from said plug to discharge residual molten metal and the cylinder unit being adapted to move the sliding plate horizontally so that the bubble injecting porous plug or residual metal discharging hole is positioned directly below said aperture.

14. An apparatus according to claim 8, in which the molten-metal feeding section of said intermediate vessel is circular in cross section.

* * * * *